US010390390B2

(12) United States Patent
Wu et al.

(10) Patent No.: US 10,390,390 B2
(45) Date of Patent: Aug. 20, 2019

(54) ELECTRONIC APPARATUS AND LIGHT-EMITTING MODULE DRIVING CIRCUIT THEREOF

(71) Applicant: PEGATRON CORPORATION, Taipei (TW)

(72) Inventors: Sheng-Tsai Wu, Taipei (TW); Chun-Hsien Chen, Taipei (TW); Yi-Chun Chou, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/203,282

(22) Filed: Nov. 28, 2018

(65) Prior Publication Data

US 2019/0191503 A1 Jun. 20, 2019

(30) Foreign Application Priority Data

Dec. 14, 2017 (TW) ..... 106144035 A

(51) Int. Cl.
*H05B 33/08* (2006.01)
*H05B 37/02* (2006.01)

(52) U.S. Cl.
CPC ..... *H05B 33/0806* (2013.01); *H05B 33/0857* (2013.01); *H05B 37/0227* (2013.01)

(58) Field of Classification Search
CPC ..... H05B 33/08; H05B 33/0806; H05B 33/0842; H05B 33/0857; H05B 37/02; H05B 37/0227; H05B 37/0272
See application file for complete search history.

(56) References Cited

U.S. PATENT DOCUMENTS 6,836,157 B2 12/2004 Rader et al.
7,994,725 B2 * 8/2011 Bouchard ..... H05B 33/0818 315/122
8,610,360 B2 12/2013 Hsu et al.

FOREIGN PATENT DOCUMENTS

TW I415524 11/2013

* cited by examiner

*Primary Examiner* — Jimmy T Vu
(74) *Attorney, Agent, or Firm* — J.C. Patents

(57) ABSTRACT

An electronic apparatus and a light-emitting module driving circuit thereof are provided. The electronic apparatus includes a light-emitting module and a driving circuit. The driving circuit is coupled to the light-emitting module and is configured to generate a driving signal set to drive the light-emitting module. The driving circuit includes a first driver, a second driver, and a switching circuit. The first driver receives a control signal related to an operation status of the electronic apparatus and generates a first signal set according to the control signal. The second driver includes at least one resistor which receives system power and accordingly generates a second signal set. The switching circuit is coupled to the first driver and the second driver to receive the first signal set and the second signal set, respectively. When the switching circuit does not receive the first signal set, the switching circuit takes the second signal set as the driving signal set.

10 Claims, 2 Drawing Sheets

ELECTRONIC APPARATUS AND LIGHT-EMITTING MODULE DRIVING CIRCUIT THEREOF

CROSS-REFERENCE TO RELATED APPLICATION

This application claims the priority benefit of Taiwan application serial no. 106144035, filed on Dec. 14, 2017. The entirety of the above-mentioned patent application is hereby incorporated by reference herein and made a part of this specification.

BACKGROUND

Technical Field

The invention relates to a driving circuit. More particularly, the invention relates to a light-emitting module driving circuit and an electronic apparatus having the light-emitting module driving circuit.

Description of Related Art

Today's electronic products not only have to feature a favorable computing function but also have to provide a decoration or atmosphere sync function, so as to attract consumers' attention. Hence, light emitting diodes (LEDs) are used to be disposed in electronic products by a designer most of the time and are designed to emit a variety of atmosphere lights according to the statuses of the electronic products. In this way, the electronic products can not only show the statuses but also feature appealing appearances.

Nevertheless, when an electronic product is turned on to perform a booting operation, since the driving circuit of a light emitting diode is not completely activated yet (e.g., the firmware of the driving circuit is not loaded yet), the light emitting diodes are not on or the colors of the light emitting diodes cannot be adjusted during the booting operation. As a result, the user may not be able to know the current status of the electronic product.

SUMMARY

In view of the above, the invention provides an electronic apparatus and a light-emitting module driving circuit thereof in which brightness or a color of a light-emitting module can be adjusted by the light-emitting module driving circuit when the electronic apparatus is turned on to perform a booting operation.

In an embodiment of the invention, an electronic apparatus includes a light-emitting module and a driving circuit. The driving circuit provided by the embodiment of the invention is coupled to the light-emitting module and is configured to generate a driving signal set to drive the light-emitting module. The driving circuit includes a first driver, a second driver, and a switching circuit. The first driver is configured to receive a control signal related to an operation status of the electronic apparatus and generate a first signal set according to the control signal. The second driver includes at least one resistor, wherein the at least one resistor is configured to receive system power and accordingly generate a second signal set. The switching circuit is coupled to the first driver and the second driver to receive the first signal set and the second signal set respectively.

When the switching circuit does not receive the first signal set, the switching circuit takes the second signal set as the driving signal set.

In an embodiment of the invention, the driving circuit further includes a controller. The controller is coupled to the first driver and the switching circuit. The controller is configured to generate the control signal after the electronic apparatus completes a booting operation. The controller is further configured to generate and output a selection signal to the switching circuit. During the booting operation, the selection signal instructs the switching circuit to take the second signal set as the driving signal set. After the electronic apparatus completes the booting operation, the selection signal instructs the switching circuit to take a first signal set as the driving signal set.

In an embodiment of the invention, during the booting operation after the electronic apparatus is turned on, the controller does not output the control signal and the first driver does not generate the first signal set.

In an embodiment of the invention, the at least one resistor is a variable resistor.

In an embodiment of the invention, the at least one resistor is a thermal resistor, and a temperature coefficient of the thermal resistor is a positive temperature coefficient or a negative temperature coefficient.

To sum up, in the electronic apparatus and the light-emitting module driving circuit thereof provided by the embodiments of the invention, the light-emitting module driving circuit may adjust the brightness and the color of the light-emitting module when the electronic apparatus is turned on to perform the booting operation. In this way, the electronic apparatus not only shows the operation status but also features an appealing appearance.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION

Figure 1:
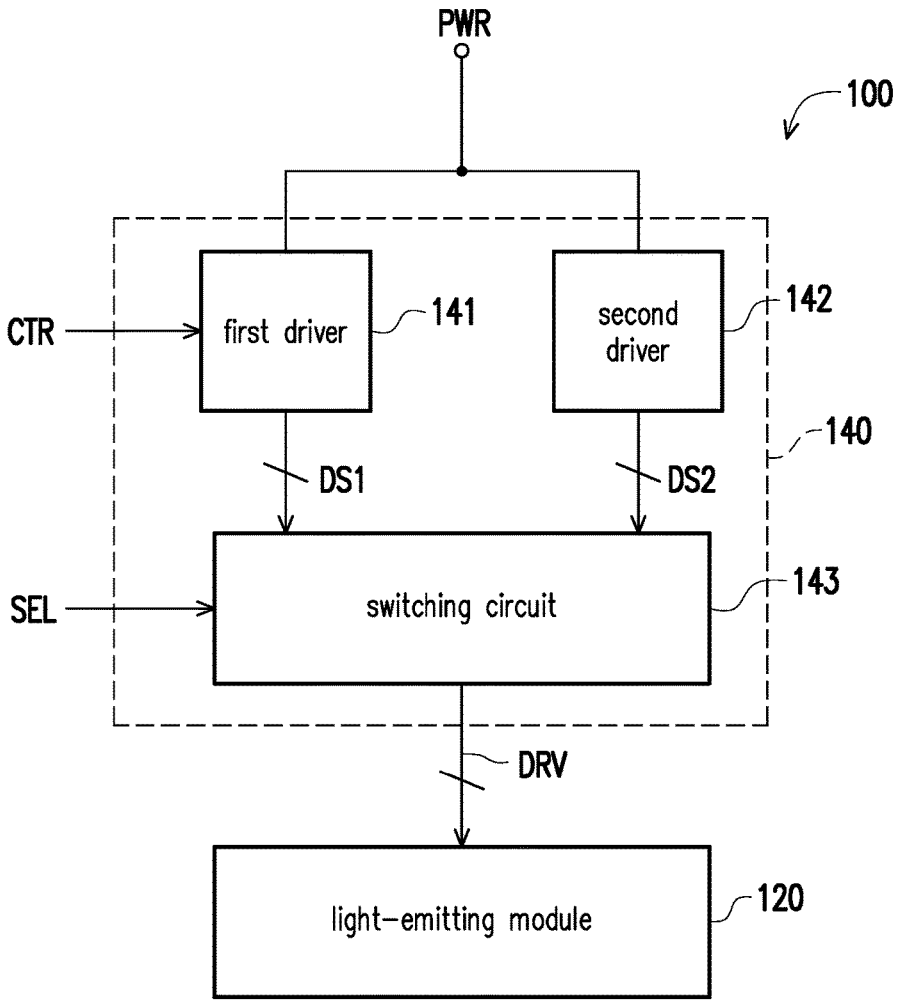
FIG. 1 illustrates a schematic circuit block diagram of an electronic apparatus according to an embodiment of the invention.

In order to make the invention more comprehensible, several embodiments are described below as examples of implementation of the invention. In addition, wherever possible, identical or similar reference numerals stand for identical or similar elements/components in the drawings and the embodiments.

With reference to FIG. 1, FIG. 1 illustrates a schematic circuit block diagram of an electronic apparatus according to an embodiment of the invention. An electronic apparatus 100 is an electronic product which shows a status of its own with atmosphere light of different levels of brightness or different colors. The invention is not intended to limit a product type of the electronic apparatus 100. The electronic apparatus 100 may include a light-emitting module 120 and a driving circuit 140. In an embodiment of the invention, the light-emitting module 120 may be, for example, a light emitting diode (LED) module having at least one light emitting diode element, but the invention is not limited thereto. Nevertheless, for ease of description, the light-emitting module 120 is described as a light emitting diode module in the following exemplary embodiments.

The driving circuit 140 is coupled to the light-emitting module 120. The driving circuit 140 is configured to generate a driving signal set DRV to drive the light-emitting module 120, so that the light-emitting module 120 generates atmosphere light of different levels of brightness or different colors. To be specific, the driving circuit 140 may include a first driver 141, a second driver 142, and a switching circuit 143, but the invention is not limited thereto. The first driver 141 is coupled to a system power PWR and receives a control signal CTR. The first driver 141 may generate a first signal set DS1 according to the control signal CTR, wherein the first signal set DS1 may include at least one first signal. The second driver 142 receives the system power PWR and generates a second signal set DS2 according to the system power PWR, wherein the second signal set DS2 may include at least one second signal. The switching circuit 143 is coupled to the first driver 141 and the second driver 142 to respectively receive the first signal set DS1 and the second signal set DS2. The switching circuit 143 may select one from the first signal set DS1 and the second signal set DS2 as the driving signal set DRV according to a selection signal SEL. It could be understood that, the switching circuit 143 may take the first signal set DS1 generated by the first driver 141 or the second signal set DS2 generated by the second driver 142 as the driving signal set DRV, so that the light emitting diode element in the light-emitting module 120 presents corresponding brightness or a corresponding color according to the driving signal set DRV.

In an embodiment of the invention, the system power PWR may be, for example, direct current source, but is not limited thereto.

In an embodiment of the invention, the first driver 141 may be, for example, a light emitting diode driving integrated circuit. Firmware of the first driver 141 may be loaded to the first driver 141 after the electronic apparatus 100 completes a booting operation, such that the first driver 141 and the firmware thereof may work collaboratively and generate the first signal set DS1 according to the control signal CTR.

In an embodiment of the invention, the second driver 142 may include at least one resistor, but the invention is not limited thereto. A first terminal of each of the at least one resistor is coupled to the system power PWR, and a second terminal of each of the at least one resistor is coupled to the switching circuit 143. It could be understood that as long as the system power PWR is powered, each of the at least one resistor in the second driver 142 may generate and output one of the at least one second signal of the second signal set DS2.

In an embodiment of the invention, each of the at least one resistor in the second driver 142 may be a variable resistor, but the invention is not limited thereto. In another embodiment of the invention, each of the at least one resistor in the second driver 142 may be a thermal resistor, wherein a temperature coefficient of each thermal resistor may be a positive temperature coefficient (PTC) or a negative temperature coefficient (NTC). Moreover, the temperature coefficients of the thermal resistors may be identical to each other or may be different from each other, but the invention is not limited thereto.

In an embodiment of the invention, the switching circuit 143 may be implemented by a multiplexer or a transistor switch, but the invention is not limited thereto.

In overall operation, in a time interval when the electronic apparatus 100 is activated to perform the booting operation, since the firmware of the first driver 141 is not loaded yet (i.e., the first driver 141 is not completely activated), the first signal set DS1 is not generated by the first driver 141. Hence, before the switching circuit 143 receives the first signal set DS1 generated by the first driver 141, the switching circuit 143 may take the second signal set DS2 as the driving signal set DRV, so that the light-emitting module 120 shows the corresponding brightness or color according to the driving signal set DRV which is the second signal set DS2 at this time. In this way, a user may know that the electronic apparatus 100 is performing the booting operation. In particular, if each of the at least one resistor in the second driver 142 is the thermal resistor, a current value of each of the at least one second signal in the second signal set DS2 changes along with a temperature increase of the electronic apparatus 100. In this way, the light-emitting module 120 may have an atmosphere sync effect as a breathing lamp (i.e., the color or brightness changes gradually), and the brightness or color of the light-emitting module 120 can thus be adjusted.

From another perspective, after the electronic apparatus 100 completes the booting operation, since the firmware of the first driver 141 is loaded (i.e., the first driver 141 is completely activated), the switching circuit 143 takes the first signal set DS1 as the driving signal set DRV so that the first driver 141 works collaboratively with the firmware thereof and controls the light-emitting module 120 to show the corresponding brightness or color according to the control signal CTR. In this way, the user is aware of an operation status of the electronic apparatus.

Figure 2:
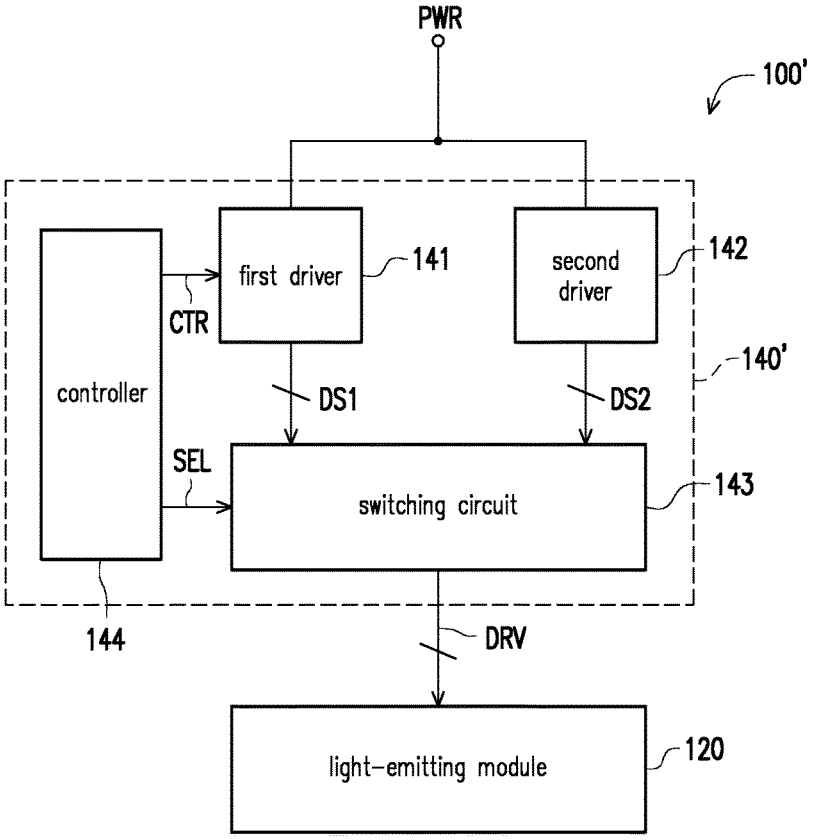
FIG. 2 illustrates a schematic circuit block diagram of an electronic apparatus according to another embodiment of the invention.

With reference to FIG. 2, FIG. 2 illustrates a schematic circuit block diagram of an electronic apparatus according to another embodiment of the invention. An electronic apparatus 100' may include a light-emitting module 120 and a driving circuit 140', wherein the driving circuit 140' may include a first driver 141, a second driver 142, a switching circuit 143, and a controller 144. The light-emitting module 120, the first driver 141, the second driver 142, and the switching circuit 143 of FIG. 2 are similar to the light-emitting module 120, the first driver 141, the second driver 142, and the switching circuit 143 of FIG. 1, respectively; thus, implementation and operation thereof may be deduced from the related description of FIG. 1, and no further explanation is provided hereinafter. Description of the controller 144 of FIG. 2 is provided as follows.

The controller 144 is coupled to the first driver 141 and the switching circuit 143. The controller 144 is configured to serve as an operation core of the electronic apparatus 100', so as to load firmware of the first driver 141 into the first driver 141. In addition, the controller 144 may further generate a selection signal SEL and a control signal CTR. Further, the selection signal SEL instructs the switching circuit 143 to take a second signal set DS2 as a driving signal set DRV during the booting operation performed by the electronic apparatus 100', and the selection signal SEL instructs the switching circuit 143 to take a first signal set DS1 as the driving signal set DRV after the electronic apparatus 100' completes the booting operation. For instance, during the booting operation after the electronic apparatus 100' is turned on, the selection signal SEL generated by the controller 144 has a second voltage level (e.g., a logic low, but not limited thereto). At this time, the switching circuit 143 takes the second signal set DS2 as the driving signal set DRV according to the selection signal SEL with the second voltage level, so that the light-emitting module 120 shows corresponding brightness or a corresponding color according to the driving signal set DRV (the second signal set DS2 at this time). In this way, the user can know that the electronic apparatus 100' is performing the booting operation. After the electronic apparatus 100' completes the booting operation, the controller 144 rises the selection signal SEL from the second voltage level to a first voltage level (e.g., a logic high, but not limited thereto), so that the switching circuit 143 takes the first signal set DS1 as the driving signal set DRV according to the selection signal SEL with the first voltage level. At this time, the controller 144 generates the control signal CTR according to an operation status of the electronic apparatus 100', and the first driver 141 generates the corresponding first signal set DS1 according to the control signal CTR, so as to control the light-emitting module 120 to show the corresponding brightness or color. In brief, the controller 144 may instruct the switching circuit 143 to take the first signal set DS1 or the second signal set DS2 as the driving signal set DRV according to the selection signal SEL with the high or low voltage level.

Incidentally, in the abovementioned example, the relationship between the logic level of the selection signal SEL and the completion of the booting operation of the electronic apparatus 100' is merely an example. People of ordinary skill in the art should know that the relationship between the logic level of the selection signal SEL and the completion of the booting operation of the electronic apparatus 100' can be defined by a designer according to practical applications or design requirements.

In an embodiment of the invention, the controller 144 may be hardware, firmware, or software or a machine executable code stored in a memory and loaded and executed by a microprocessor or a digital signal processor (DSP). If the controller 144 is implemented as the hardware, the controller 144 may be implemented by a single integrated circuit chip and may also be implemented by a plurality of circuit chips, but the invention is not limited thereto. The circuit chips or the single integrated circuit chip may be implemented by adopting an application specific integrated circuit (ASIC), a programmable logic device (PLD), or a field programmable gate array (FPGA). The memory may be, for example, a random access memory, a read-only memory, or a flash memory and the like.

In view of the foregoing, in the electronic apparatus and the light-emitting module driving circuit thereof provided by the embodiments of the invention, the light-emitting module driving circuit adjusts the brightness and color of the light-emitting module during the booting operation after the electronic is turned on. In this way, the electronic apparatus not only shows the operation status but also features an appealing appearance.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic apparatus, comprising:

a light-emitting module; and a driving circuit, coupled to the light-emitting module and configured to generate a driving signal set to drive the light-emitting module, the driving circuit comprising:

a first driver, configured to receive a control signal related to an operation status of the electronic apparatus and generate a first signal set according to the control signal;

a second driver, comprising at least one resistor, wherein the at least one resistor is configured to receive a system power and accordingly generate a second signal set; and a switching circuit, coupled to the first driver and the second driver to receive the first signal set and the second signal set respectively, the switching circuit taking the second signal set as the driving signal set when the switching circuit does not receive the first signal set.

2. The electronic apparatus as claimed in claim 1, wherein the driving circuit further comprises:

a controller, coupled to the first driver and the switching circuit and configured to generate the control signal after the electronic apparatus completes a booting operation, wherein the controller is further configured to generate and output a selection signal to the switching circuit, wherein the selection signal instructs the switching circuit to take the second signal set as the driving signal set during the booting operation, wherein the selection signal instructs the switching circuit to take the first signal set as the driving signal set after the electronic apparatus completes the booting operation.

3. The electronic apparatus as claimed in claim 2, wherein the controller does not output the control signal and the first driver does not generate the first signal set during the booting operation after the electronic apparatus is turned on.

4. The electronic apparatus as claimed in claim 1, wherein each of the at least one resistor is a variable resistor.

5. The electronic apparatus as claimed in claim 1, wherein each of the at least one resistor is a thermal resistor, and a temperature coefficient of the thermal resistor is a positive temperature coefficient or a negative temperature coefficient.

6. A driving circuit, configured to generate a driving signal set to drive a light-emitting module, the driving circuit comprising:

a first driver, configured to receive a control signal and generate a first signal set according to the control signal;

a second driver, comprising at least one resistor, wherein the at least one resistor is configured to receive a system power and accordingly generate a second signal set; and a switching circuit, coupled to the first driver and the second driver to receive the first signal set and the second signal set respectively, the switching circuit taking the second signal set as the driving signal set when the switching circuit does not receive the first signal set.

7. The driving circuit as claimed in claim 6, further comprising:

a controller, coupled to the first driver and the switching circuit and configured to generate the control signal after the first driver is completely activated, wherein the controller is further configured to generate and output a selection signal to the switching circuit, wherein the selection signal instructs the switching circuit to take the second signal set as the driving signal set when the first driver is not completely activated, wherein the selection signal instructs the switching circuit to take the first signal set as the driving signal set after the first driver is completely activated.

8. The driving circuit as claimed in claim 7, wherein the controller does not output the control signal and the first driver does not generate the first signal set when the first driver is not completely activated.

9. The driving circuit as claimed in claim 6, wherein each of the at least one resistor is a variable resistor.

10. The driving circuit as claimed in claim 6, wherein each of the at least one resistor is a thermal resistor, and a temperature coefficient of the thermal resistor is a positive temperature coefficient or a negative temperature coefficient.

* * * * *